US010494812B2

(12) United States Patent
Manov et al.

(10) Patent No.: US 10,494,812 B2
(45) Date of Patent: Dec. 3, 2019

(54) PATTERNED ROLLED ZINC ALLOY SHEET

(71) Applicant: Umicore Building Products France, Bagnolet (FR)

(72) Inventors: Stephan Manov, Toulous (FR); Christophe Bissery, Saint-Germain en Laye (FR)

(73) Assignee: Umicore Building Products France, Bagnolet (FR)

( * ) Notice: Subject to any disclaimer, the term of this patent is extended or adjusted under 35 U.S.C. 154(b) by 87 days.

(21) Appl. No.: 15/032,682

(22) PCT Filed: Oct. 31, 2014

(86) PCT No.: PCT/EP2014/073476
§ 371 (c)(1),
(2) Date: Apr. 28, 2016

(87) PCT Pub. No.: WO2015/063274
PCT Pub. Date: May 7, 2015

(65) Prior Publication Data

US 2016/0265225 A1 Sep. 15, 2016

(30) Foreign Application Priority Data

Oct. 31, 2013 (EP) ..... 13290265

(51) Int. Cl.
*E04C 2/08* (2006.01)
*C22C 18/00* (2006.01)
(Continued)

(52) U.S. Cl.
CPC ..... *E04C 2/08* (2013.01); *C22C 18/00* (2013.01); *C22C 18/02* (2013.01); *E04D 3/16* (2013.01);
(Continued)

(58) Field of Classification Search
None
See application file for complete search history.

(56) References Cited

U.S. PATENT DOCUMENTS

2011/0017602 A1 1/2011 Khosla
2013/0081951 A1 4/2013 Hankey

FOREIGN PATENT DOCUMENTS

CN 1262182 8/2000
CN 101530921 9/2009
(Continued)

OTHER PUBLICATIONS

International search report for PCT/EP2014/073476, dated Jan. 29, 2015.

*Primary Examiner* — Daniel J. Schleis
(74) *Attorney, Agent, or Firm* — NK Patent Law

(57) ABSTRACT

The present disclosure concerns specially patterned zinc sheets for coverage and protection of building roofs and facades. A recurrent problem linked with the use of zinc sheets in building applications is the development of white rust. As the complete avoidance of white rust is difficult to achieve, additional means to reduce its impact are most welcome. It is now proposed to limit the visibility of white rust by providing a camouflaging pattern on the surface of the zinc. The invention more specifically concerns an unweathered rolled zinc alloy sheet with at least one patterned face having an optical reflectivity that varies from region to region, characterized in that said regions are of a pseudo-random shape, having characteristic dimensions in the range of 0.1 mm to 10 cm; and in that the optical reflectivity, when measured across the sheet in any arbitrary direction, presents a specular reflectivity RMS deviation of more than 3 GU and/or a diffuse reflectivity RMS deviation
(Continued)

of more than 0.2. A laser-aided imprinting process is disclosed to generate suitable camouflage patterns on the zinc.

6 Claims, 1 Drawing Sheet

(51) Int. Cl.

| | |
|---|---|
| ***C22C 18/02*** | (2006.01) |
| ***E04F 13/12*** | (2006.01) |
| ***E04D 3/30*** | (2006.01) |
| ***E04D 3/16*** | (2006.01) |
| *C22F 1/16* | (2006.01) |

(52) U.S. Cl.
CPC ..... *E04D 3/30* (2013.01); *E04F 13/12* (2013.01); *C22F 1/165* (2013.01)

(56) References Cited

FOREIGN PATENT DOCUMENTS

| | | |
|---|---|---|
| EP | 2302106 | 9/2017 |
| GB | 1258214 | 12/1971 |
| GB | 2038371 | 7/1980 |
| JP | H02 93034 | 4/1990 |
| JP | H03 33357 | 2/1991 |
| JP | H03 224951 | 10/1991 |
| JP | H06 88248 | 3/1994 |
| JP | H06 126889 | 5/1994 |
| KR | 20130000920 | 1/2013 |
| WO | 2012139887 | 10/2012 |

PATTERNED ROLLED ZINC ALLOY SHEET

This application is a National Stage application of International Application No. PCT/EP2014/073476, filed Oct. 31, 2014. This application also claims priority under 35 U.S.C. § 119 to European Application No. 13290265.1, filed Oct. 31, 2013.

The present disclosure concerns specially patterned zinc sheets for coverage and protection of building roofs and facades.

A recurrent problem linked with the use of zinc sheets in building applications is the development of white rust. White rust is a porous corrosion product comprising zinc hydroxides, carbonates and water, which is also known as wet storage stain. It frequently develops when a fresh zinc surface is stored in a wet and confined environment with limited availability of oxygen and carbon dioxide. It may also develop shortly after placement, when subjected to natural outdoor atmospheric conditions before the zinc surface has had time to form a natural patina, which provides good corrosion protection.

White rust typically starts as small white specks having a diameter of 0.1 to 1 mm. The specks may then grow larger and form whitish patches of larger dimensions. Such patches have seemingly random locations and shapes.

White rust does not endanger or otherwise shorten the life expectancy of the zinc sheet. It nevertheless is considered unaesthetic. It is detrimental to the attractiveness of the product and it may even cast a doubt on its integrity.

There have been numerous recommendations to avoid white rust. Storage with proper ventilation is generally recommended. Strict storage requirements are however difficult to guarantee, in particular once the zinc has been shipped to customers. Therefore, surface passivation treatments or coatings are often applied. These treatments do prevent white rust, but they also interfere with the natural weathering of the zinc. The greatly delayed natural weathering is an undesired side effect of most anti white-rust protective treatments.

A totally different approach is herewith provided: as the complete avoidance of white rust is difficult to achieve, additional means to reduce its impact are most welcome. It is now proposed to limit the visibility of white rust by providing a camouflaging pattern on the surface of the zinc.

It must be said that, once exposed to the external atmosphere, natural weathering sets in and this will, after time, also result in the decreased visibility of white rust. The present invention concerns freshly manufactured zinc sheets, which are therefore still in an un-weathered or un-aged condition, thus having not yet developed a natural patina. It is indeed this new product that needs also to have an appropriate appearance, not only when seen from a distance on a roof or façade, but also when handled by the craftsman during placement.

The invention more specifically concerns an un-weathered rolled zinc alloy sheet with at least one patterned face having an optical reflectivity that varies from region to region, characterized in that said regions are of a pseudo-random shape, having characteristic dimensions in the range of 0.1 mm to 10 cm; and in that the optical reflectivity, when measured across the sheet in any arbitrary direction, presents a specular reflectivity RMS (root mean square) deviation of more than 3 GU and/or a diffuse reflectivity RMS deviation of more than 0.2. The specular reflectivity is measured according to ISO 7668, and the diffuse reflectivity according to ISO 7724/1.

The product presents a reflectivity varying randomly from region to region across the sheet. This variation of the reflectivity has to be proportionate to the dimension of the white rust patches that need to be camouflaged. In practice, it is desired to mask white rust in the form of small speckles of about 0.1 mm, up to larger areas having dimensions of 10 cm or more. The camouflage pattern needs to have similar characteristic dimensions.

By characteristic dimension is meant the linear dimension of darker or brighter regions as can be measured between successive maxima or minima on a reflectivity map of the sheet.

The varying reflectivity can also be defined as containing spatial frequency components in the range of 100 $cm^{-1}$ to 0.1 $cm^{-1}$. A range of 10 $cm^{-1}$ to 0.1 $cm^{-1}$ is preferred. This definition is an alternative to the definition based on the characteristic dimension.

The pseudo-random shape of the regions is also an essential feature. Repeating patterns would be contrary to the aim of preserving the natural aspect of the product. However, long-range (such as of more than 2 meter) pattern repetitions could be tolerated as these will not be obvious when the product is cut and placed in customary ways on roofs or facades. Similarly, very short range repetitions (such as of less than 0.1 mm) are not detrimental as these are nearly invisible to the unaided eye.

By pseudo-random is meant that the location and the patterning is defined during the manufacturing process, e.g. based on an algorithm using random number generation.

The camouflaging pattern should result in optical reflectivity variations of a sufficient amplitude to effectively mask white rust or other surface imperfections. Although the above-mentioned RMS deviation generally suffice, preferred values are a specular reflectivity RMS deviation of more than 5 GU and/or a diffuse reflectivity RMS deviation of more than 0.5

These variations are the values that can be obtained using normally available commercial equipment. Such equipment reports reflectivity as sampled across a surface of about 1 by 1 cm. This means that variations present at scales substantially below 1 cm will be underestimated.

The mentioned RMS deviation should preferably be reached when considering spatial frequencies in the range of 100 $cm^{-1}$ to 0.1 $cm^{-1}$, and more preferably in the range of 10 $cm^{-1}$ to 0.1 $cm^{-1}$.

The optical appearance of a surface is the result of complex phenomena. The reflection of light indeed depends on many factors, mainly the angle of illumination, the angle of view, the wavelength (or spectrum) of the light, and the polarization. Possible diffractive effects could further complicate the situation. The penetration depth also plays an important role for translucent materials.

With respect to the present invention, it however sufficed to characterize the reflectivity of the surface by its specular reflection and by is diffuse reflection. Both modes are indeed individually capable of hiding white rust.

The specular reflectivity can be measured using a gloss meter type AG-4446 (Micro Gloss). This instrument uses 3 geometries, with standard illumination angles of 20, 60 and 80°, to cope with all kinds of surfaces, and is compliant with ISO 7668. An ideally matte surface yields a value of 0 GU (Gloss Units), while a highly polished black surface yields a value of 100 GU. This scale allows for values above 100 GU for non-black highly polished surfaces.

The diffuse reflectivity is measured using a spectrophotometer type CM-2500d (Konica Minolta), compliant with ISO 7724/1. The reflectivity is reported in terms of lightness (L*) in the CIELAB color space on a 0 to 100 scale, black yielding 0 and white yielding 100. The light source is according to D65, which is a common standard illuminant defined by the International Commission on Illumination (CIE).

The divulged product presents a variable specular and/or diffuse reflectivity. This reflectivity varies randomly across any linear measurement track and with sufficient amplitude excursions to camouflage white rust. The amplitude excursions are quantified in term of RMS deviation around the mean value of the measured track.

A zinc sheet surface having a diffuse reflectivity of more than 75 is preferred. Such a rather bright tint of gray indeed favors the concealment of white rust. This result can be achieved by the same means as those used for imprinting the variable reflectivity patterns.

Although color variations across a zinc sheet could help in hiding white rust, it is indeed preferred to preserve the grayish tint of natural zinc. Gray is defined as a "color" with a low saturation in the color space. This result can be achieved by the same means as those used for imprinting the variable reflectivity patterns. A zinc sheet surface having a saturation level of less than 20% in the hue-saturation-lightness (HLS) color space is therefore favored.

The presence of stripes on the surface of zinc sheets is an unavoidable consequence of the usual manufacturing process involving rolling. These rolling stripes impart an inherent anisotropy to the sheet, clearly showing the rolling direction. Their presence tends to emphasize other surface defects such as white rust, scratches and finger prints. The reason is that the latter artifacts are predominantly isotropic and will as such contrast with the stripes. It is therefore preferred do render the stripes less prominent or even invisible. This result can be achieved by the same means as those used for imprinting the variable reflectivity patterns.

Other advantages of the product are a lower visibility of scratches, of fingerprints, or of other dirt deposits. Similarly, a limited color or shade variation, or a slight lack of flatness will be masked.

A zinc sheet surface made of a Zn—Cu—Ti alloy according to the EN 988 norm is preferred as this is the normative quality standard for building applications.

There are several means by which a zinc sheet can be rendered locally more or less reflective. These means can be classified as either optical, chemical, mechanical, or thermal.

Inhomogeneous coatings, characterized by a variable thickness or color, could be used to impart the required patterning to the zinc. Although this system is not excluded, it cannot be recommended in view of the intended effect. Indeed, coatings, and thick coatings in particular, may inappropriately delay the natural weathering of the material.

Chemical etching using an inhomogeneous etching solutions randomly distributed across the sheet could also be used. Although this system is not excluded, precise process control would be difficult to maintain and reproducibility could suffer.

Mechanical means, such as multiple embossments, are well suited to modify significantly the surface texture and thus the reflectivity of zinc sheets.

Thermal means, such as by using a powerful thermal source, e.g. a laser, are also suitable to imprint the surface with almost any desired pattern.

Suitable microstructures can be characterized by a succession of hills and dales situated within a range of 1 to 100 μm above or below the mean surface plane the sheet. These microstructures will locally modify the optical reflectivity of the surface. Varying the type or the density of these microstructures across the surface of the sheet will result in a correspondingly varying optical reflectivity.

The following example illustrates the invention.

One surface of an un-weathered EN 988 rolled Zn—Cu—Ti sheet is patterned by subjected it to laser pulses according to the process described below.

Use is made of a TruMark station 5000 laser marking station equipped with a TruMark 6020 laser Nd-YAG source emitting at 1064 nm. This laser has a mean output power of 17 W. The spot diameter is 116 μm. It is pulsed at a rate ranging from 10 to 60 kHz, thereby producing pulses with an energy range of 1.5 to 0.3 mJ. The energy of individual pulses drops with the increase of the repetition rate as the optical charging time between pulses decreases. The pulse duration is fixed at 5 μs.

It has been demonstrated that the above levels of energy allow for the formation of small craters or pits on the surface of the zinc. The diameter of these pits ranges from 10 μm to 100 μm corresponding to energies ranging from 0.3 to 1.5 mJ.

Different shades can be obtained by modulating the energy of the pulses: higher energies result in lager pits and in a darker appearance of the surface.

Different shades can also be obtained by dithering: grouping pits closer together will result in a darker appearance than thinly distributed pits. This can be controlled by adapting the repetition rate, but also by changing the linear scanning speed. Scanning speeds ranging from 0.2 to 10 m/s are suitable.

A large number of closely spaced low-energy pits will decrease the natural glossiness of the metal. It also will mask the rolling stripes.

The above is illustrated in FIG. 1, showing the resulting surface appearance on microphotographs. The pattern shown is obtained by using a pulse rate of 45 kHz, a linear scanning speed of 2 m/s, and 50 μm line spacing (also known as hatch spacing).

The desired pseudo-random pattern that is to be transferred to the zinc sheet is pre-calculated using pseudo-random pattern generation. After conversion into a compatible digital format, the data is uploaded to the laser marking workstation.

This station comprises all software and hardware needed to scan the zinc sheet, line by line, and for pulsing the laser beam according to the desired pattern. In the present example, the equipment manufacturer's standard conditions for imprinting metals are adopted.

Figure 1:
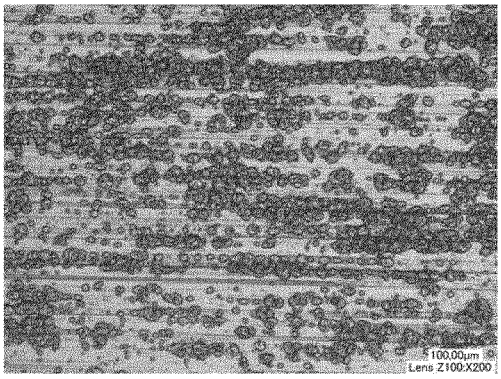
Figure 2:
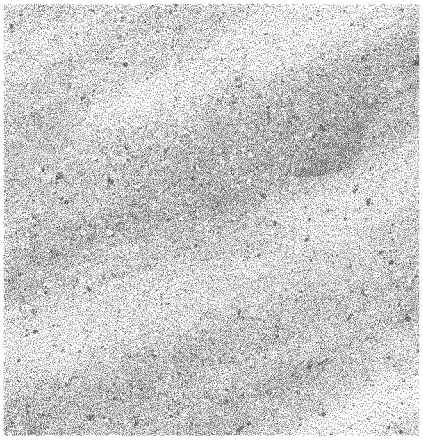
FIG. 2 shows a pre-calculated pseudo-random pattern as printed on paper.
Figure 3:
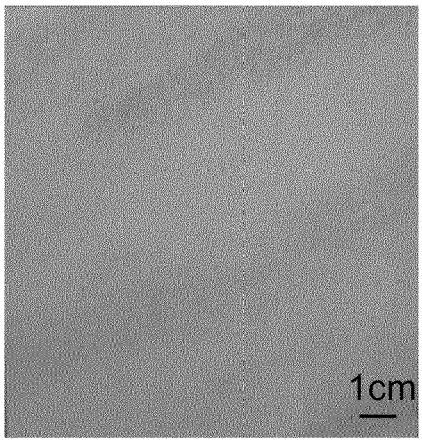
FIG. 3 shows a photo of the pattern transferred to the zinc sheet. Although brightness and contrast are different from the paper print, the result is adequate for masking white rust.

The specular reflectivity of the obtained zinc is about 9.9 GU (measured at) 60°) with a RMS deviation of 4 GU.

The surface of the obtained imprinted products can be further subjected to chemical treatment such as phosphate conversion. This preserves the general aspect of the product while improving its corrosion resistance.

The invention claimed is:

1. An un-weathered rolled zinc alloy sheet for coverage and protection of buildings, the sheet comprising a patterned face having a pattern resulting in a varying optical reflectivity defining a reflectivity map of the face, said face having regions, wherein:

the pattern is pseudo-random and said regions are of a pseudo-random shape, with no repeating patterns in the reflectivity map over distances within a range of 0.1 mm to 2 m;

said regions include darker regions delimited by two successive maxima on the reflectivity map in any arbitrary direction, and brighter regions delimited by two successive minima on the reflectivity map in any arbitrary direction, said two successive maxima and said two successive minima being respectively separated by characteristic dimensions in the range of 0.1 mm to 10 cm; and the optical reflectivity, when measured across the sheet in any arbitrary direction, presents a specular reflectivity RMS deviation of more than 3 GU and/or a diffuse reflectivity RMS deviation of more than 0.2.

2. The zinc sheet according to claim 1, wherein said patterned face has microstructures imprinted thereon and wherein some of the regions comprise microstructures having a higher optical reflectivity, and some of the regions comprise microstructures having a lower optical reflectivity.

3. The zinc sheet according to claim 2, wherein the imprinted microstructures are formed by either one or both of hills and dales situated within a range of 1 to 100 μm above or below the mean surface of the sheet.

4. The zinc sheet according to claim 1, wherein the mean optical reflectivity of the patterned face of the sheet has a diffuse reflectivity value of more than 75.

5. The zinc sheet according to claim 1, wherein the mean saturation level of the patterned face of the sheet has a value of less than 20% in the hue-saturation-lightness (HLS) color space.

6. The zinc sheet according to claim 1, wherein the zinc alloy is a Zn—Cu—Ti alloy according to the EN 988 norm.

* * * * *